US011027324B2

(12) United States Patent
Thiyagarajan et al.

(10) Patent No.: US 11,027,324 B2
(45) Date of Patent: Jun. 8, 2021

(54) SINGLE PIECE VEHICLE WHEEL MANUFACTURING PROCESS

(71) Applicant: WHEELS INDIA LTD, Padi, Chennai, Tamilnadu (IN)

(72) Inventors: Sundararajan Thiyagarajan, Chennai (IN); Muthuraj Ramasamy, Chennai (IN); Rajasekar L, Chennai (IN); Jonathan Kinston Benthambu, Chennai (IN)

( * ) Notice: Subject to any disclaimer, the term of this patent is extended or adjusted under 35 U.S.C. 154(b) by 0 days.

(21) Appl. No.: 15/779,557

(22) PCT Filed: Mar. 7, 2018

(86) PCT No.: PCT/IB2018/051463
§ 371 (c)(1),
(2) Date: May 29, 2018

(87) PCT Pub. No.: WO2019/048939
PCT Pub. Date: Mar. 14, 2019

(65) Prior Publication Data

US 2020/0188985 A1 Jun. 18, 2020

(30) Foreign Application Priority Data

Sep. 6, 2017 (IN) ..... 201741031520

(51) Int. Cl.
*B21D 22/14* (2006.01)
*B21D 53/30* (2006.01)

(52) U.S. Cl.
CPC ..... *B21D 22/14* (2013.01); *B21D 53/30* (2013.01)

(58) Field of Classification Search
CPC ..... B21D 53/26; B21D 53/264; B21D 53/30; B21D 53/14; B21D 53/16; B21D 53/18; Y10T 29/49503; Y10T 29/49496; Y10T 29/49492; Y10T 29/49481
See application file for complete search history.

(56) References Cited

U.S. PATENT DOCUMENTS 4,897,909 A * 2/1990 LaVoy ..... B21D 53/26 29/802
2008/0252136 A1* 10/2008 Srivats ..... B21D 53/264 301/63.109
2009/0278399 A1* 11/2009 Srivats ..... B21D 22/16 301/95.101

* cited by examiner

*Primary Examiner* — Pradeep C Battula

(57) ABSTRACT

The method includes the steps of placing a metal band (101) in a mandrel (102) provided at a machining tool; forming the metal band/work piece (101) for making a desired length of rim (201) and a wheel disc (202); spinning a nave portion (401) of the work piece (101) for shaping the wheel disc (202); spinning the work piece (101) for making a disc flange (502) and a gutter portion (504) of the wheel; rolling the rim portion to form the required gutter portion (504) of predetermined shape and thickness; spinning the rim portion further to form a tyre seat and well area (701); forming a flange flare (801) by bending the rim portion; forming the flange portion (901) of the wheel rim by bending the flange flare (801); machining flange edge (1201), nave (1202) and bore; reaming of bolt holes and chamfering bores at the wheel disk portion.

4 Claims, 3 Drawing Sheets

SINGLE PIECE VEHICLE WHEEL MANUFACTURING PROCESS

FIELD OF INVENTION

The embodiment herein generally relates to the field of manufacturing vehicle wheel out of a single piece. More specifically, the embodiment provides a novel method for manufacturing a vehicle wheel using single metal band. Further, the method provides a vehicle wheel manufacturing process with simple steps without the need for reverse rolling and splitting of work piece.

BACKGROUND AND PRIOR ART

In general, for manufacturing a wheel for a vehicle different methods are followed. The wheels can be made by assembling a multi piece wheel or the wheels can be manufactured using a single piece. In multi piece wheel manufacturing process, a central disc of the wheel and a wheel rim are formed separately. Further the central disc and wheel rim have to be assembled accordingly and welded together as a final wheel for a vehicle. In case of a single piece wheel manufacturing process, the whole wheel is formed using a single blank that can be a cylindrical, circular or rectangular metal sheet.

Some facts need to be considered, while assembling and welding final multi piece wheel for a vehicle. The rim must be machined appropriately to prevent damage to the tire, due to the presence of sharp edges in the rim portion. Further, the rim should be air tight to maintain the air pressure in between the tire and rim. In order to avoid such contemplation, manufacturers prefer single piece wheels manufacturing.

Generally, in the single piece wheel manufacturing process, the requirement for raw material is less when compared to multi piece wheel. The fabrication process is also simple. Further, the single piece wheel manufacturing process eliminates stress concentration due to the welding process as welding is not required in the single wheel manufacturing process as opposed to a multi piece wheel. In addition to that the production cost is also lesser in a single wheel process when compared to the multi piece wheel manufacturing process.

Vehicle wheels fabricated from a single piece of metal are already known in the prior art. In the existing prior arts, the single piece wheel manufacturing process requires reverse rolling to form a flange portion. Further in another prior art, the process requires splitting the metal portion for forming the hub portion. In some cases, to form the flange and hub portion the metal blank thickness is reduced and then accordingly deformed to the required shape.

Therefore, there is a need to develop a single piece wheels manufacturing process with simple steps without the need for reverse rolling. Further, there is a need for a novel method to manufacture a wheel using single band without the need for splitting process. Furthermore, there is a need for a novel method to manufacture a vehicle wheel without subjecting the work piece to more stress and tension.

Objects of the Invention

Some of the objects of the present disclosure are described herein below:

A main object of the present invention is to provide a novel method for manufacturing a vehicle wheel using single metal band as a work piece.

Another object of the present invention is to provide a novel method for manufacturing a vehicle wheel with simple fabrication techniques.

Still another object of the present invention is to provide a novel method for manufacturing a vehicle wheel without the need for reverse rolling for obtaining a flange portion.

Yet another object of the present invention is to provide a novel method for manufacturing a vehicle wheel component without the need for splitting the work piece.

Another object of the present invention is to provide a novel method for manufacturing a vehicle wheel at low cost.

The other objects and advantages of the present invention will be apparent from the following description when read in conjunction with the accompanying drawings, which are incorporated for illustration of preferred embodiments of the present invention and are not intended to limit the scope thereof.

SUMMARY OF THE INVENTION

In view of the foregoing, an embodiment herein provides a novel method for manufacturing a vehicle wheel using single metal band as a work piece. The method for manufacturing a vehicle wheel with a single work piece comprising the steps of, placing a metal band in a mandrel provided at a machining tool; forming the metal band/work piece for making a desired length of rim and a wheel disc; wherein size of the rim and the wheel disc can be formed according to the requirement; spinning a nave portion of the work piece for shaping the wheel disc; wherein the nave spinning of the work piece can be utilized to fix an inner width of the wheel; spinning the work piece for making a disc flange and a gutter portion of the wheel; rolling one end of the rim portion of the work piece that is connected to the wheel disc portion, to form the required gutter portion of predetermined shape and thickness; spinning the rim portion of the work piece further to form a tire seat and well area; forming a flange flare by bending another end of the rim portion; forming the flange portion of the wheel rim by bending the flange flare to desired shape; machining flange edge, nave and bore to avoid sharp edges; reaming of bolt holes and chamfering bores at the wheel disk portion of the wheel.

According to an embodiment, before performing the spinning process for forming the gutter and disc flange portion of the wheel, boltholes and a central bore is formed. Further, after forming the flange portion at another end of the rim portion, air hole for the wheel disc is pierced and coining the air hole is also performed. The machining process is performed for obtaining final desired shape of the wheel.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION OF THE PREFERRED EMBODIMENTS

Figure 1:
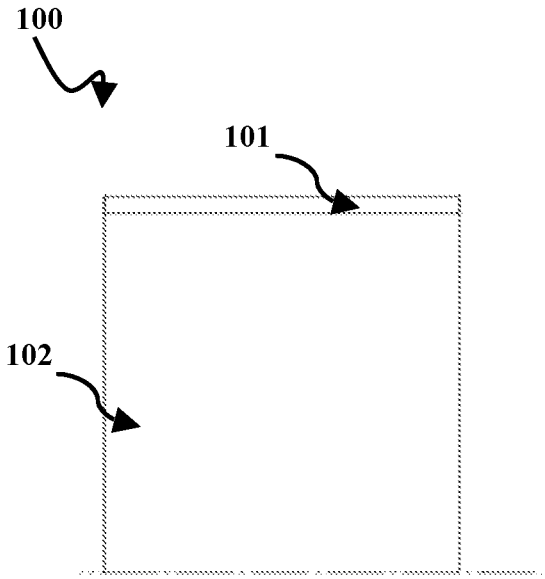
FIG. 1 illustrates sectional view of metal band fixed onto a machining tool, according to an embodiment herein.

The embodiments herein and the various features and advantageous details thereof are explained more fully with reference to the non-limiting embodiments and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned above, there is a need for a method to manufacture a vehicle wheel with a single work piece. The embodiments herein achieve this by providing a method for manufacturing a vehicle wheel without the need for reverse rolling or splitting of the work piece. Referring now to the drawings, and more particularly to FIGS. 1 through 12, where similar reference characters denote corresponding features consistently throughout the figures, there are shown preferred embodiments.

According to an embodiment, a method for manufacturing a vehicle wheel with a single work piece comprising the steps of, placing a metal band in a mandrel provided at a machining tool; forming the metal band/work piece for making a desired length of rim and a wheel disc; wherein size of the rim and the wheel disc can be formed according to the requirement; spinning a nave portion of the work piece for shaping the wheel disc; wherein the nave spinning of the work piece can be utilized to fix an inner width of the wheel; spinning the work piece for making a disc flange and a gutter portion of the wheel; rolling one end of the rim portion of the work piece that is connected to the wheel disc portion, to form the required gutter portion of predetermined shape and thickness; spinning the rim portion of the work piece further to form a tyre seat and well area; forming a flange flare by bending another end of the rim portion; forming the flange portion of the wheel rim by bending the flange flare to desired shape; machining flange edge, nave and bore to avoid sharp edges; reaming of bolt holes and chamfering bores at the wheel disk portion of the wheel.

According to an embodiment, before performing the spinning process for forming the gutter and disc flange portion of the wheel, bolt holes and a central bore is formed. Further, after forming the flange portion at another end of the rim portion, air hole for the wheel disc is pierced and coining the air hole is also performed. The machining process is performed for obtaining final desired shape of the wheel.

FIG. 1 illustrates sectional view of metal band 100 fixed onto a machining tool, according to an embodiment. The metal band 101 is placed in a mandrel 102 provided at a machining tool. The weight of the metal band is taken according to the wheel size requirement.

Figure 2:
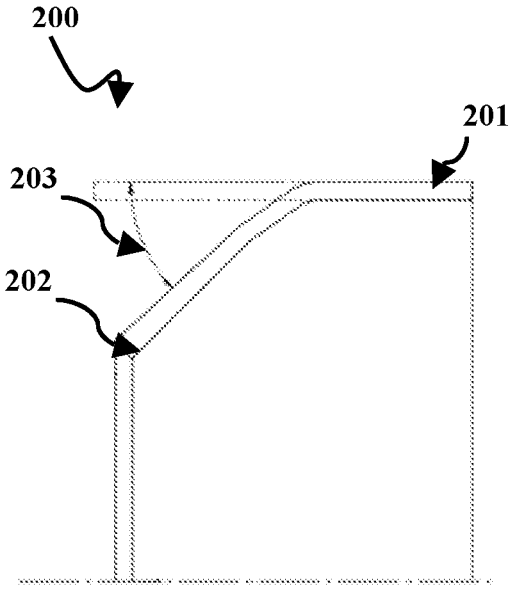
FIG. 2 illustrates sectional view of first spin forming process, according to an embodiment herein.

FIG. 2 illustrates sectional view 200 of first spin forming process, according to an embodiment. The metal band/work piece 101 is undergone first, forming process for making a desired length of rim 201 and a wheel disc 202; wherein size of the rim and the wheel disc can be formed according to the requirement. The metal band is bent to a predetermined angle 203 to form the desired wheel disc portion 202 with a predetermined thickness.

Figure 3:
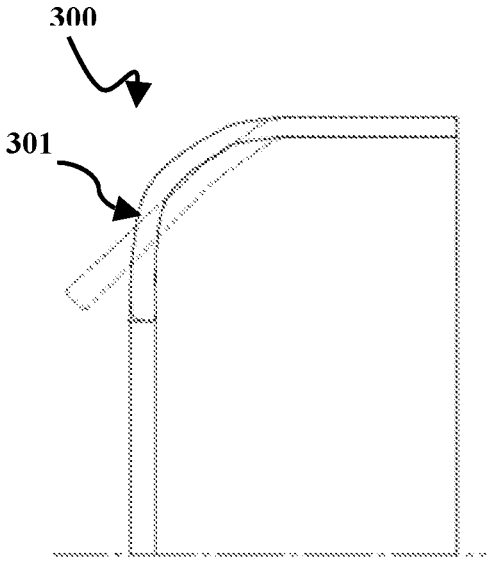
FIG. 3 illustrates sectional view of final spin forming process, according to an embodiment herein.

FIG. 3 illustrates sectional view of final spin forming process 300, according to an embodiment. During final forming process the work piece is bent according to the required angle for making the wheel disc portion 301 and the wheel rim.

Figure 4:
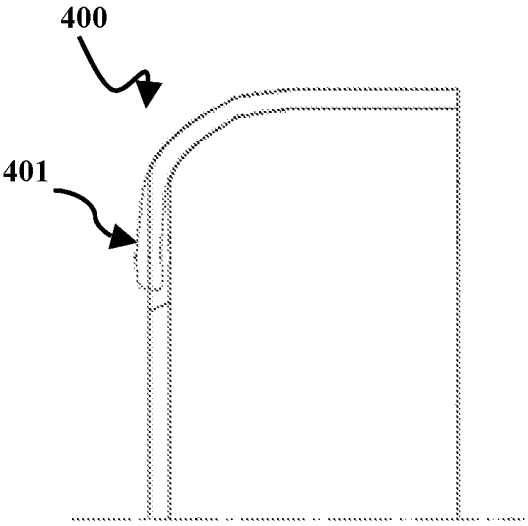
FIG. 4 illustrates sectional view of nave spinning process, according to an embodiment herein.

FIG. 4 illustrates sectional view of nave spinning process 400, according to an embodiment. A nave portion 401 of the work piece is undergone for a spinning process for shaping the wheel disc; wherein the nave spinning of the work piece can be utilized to fix an inner width of the wheel.

Figure 5:
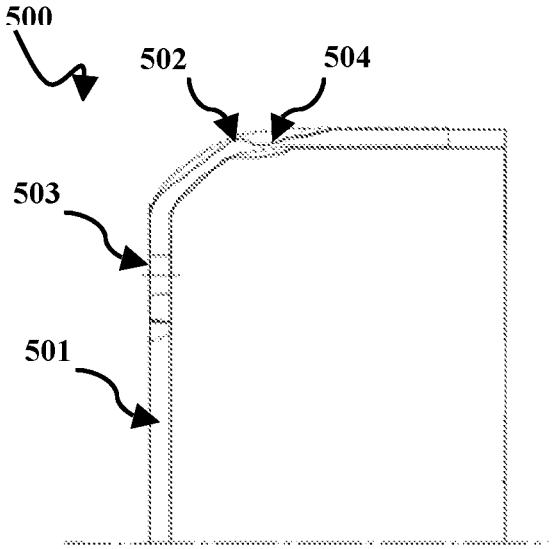
FIG. 5 illustrates sectional view of disc flange & gutter spinning process, according to an embodiment herein.

FIG. 5 illustrates sectional view of disc flange & gutter spinning process 500, according to an embodiment. The work piece is further undergone for spinning process to make a disc flange 502 and a gutter portion 504 of the wheel. Before performing the spinning process for forming the gutter and disc flange portion of the wheel, bolt holes 503 and a central bore 501 is formed.

Figure 6:
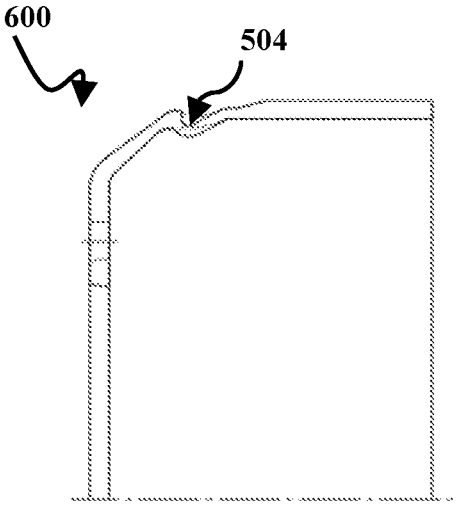
FIG. 6 illustrates sectional view of gutter rolling process, according to an embodiment herein.

FIG. 6 illustrates sectional view of gutter rolling process 600, according to an embodiment. The one end of the rim portion that is connected to the wheel disc portion is undergone for a rolling process to form the gutter portion 504 of required shape and thickness. During rolling process the weight of the rim portion get increased.

Figure 7:
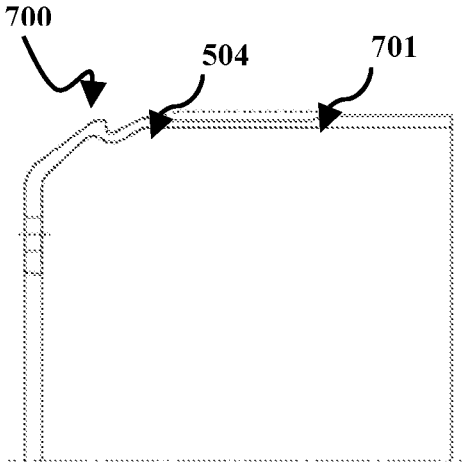
FIG. 7 illustrates sectional view of type seat and well area spinning process, according to an embodiment herein.

FIG. 7 illustrates sectional view of type seat and well area spinning process 700, according to an embodiment. The rim portion of the work piece further undergone for a spinning process to form a tyre seat and well area 701. The well area 701 has a reduced width compared to the rim portion.

Figure 8:
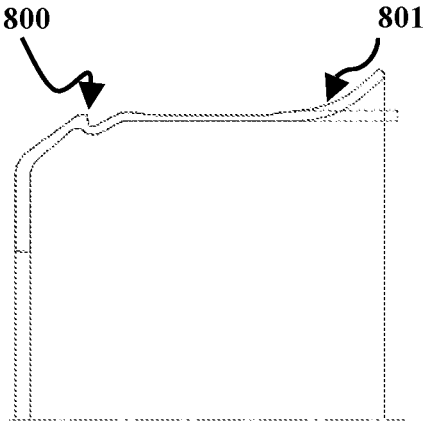
FIG. 8 illustrates sectional view of flange flare process, according to an embodiment herein.

FIG. 8 illustrates sectional view of flange flare process 800, according to an embodiment. Using the forming process a flange flare 801 is formed by bending another end of the rim portion outwardly.

Figure 9:
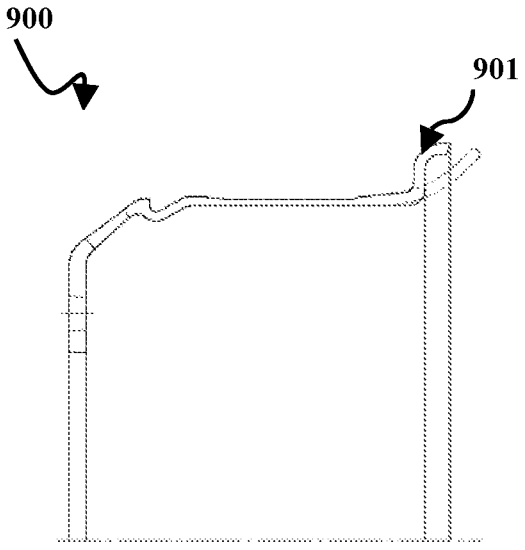
FIG. 9 illustrates sectional view of flange forming process, according to an embodiment herein.

FIG. 9 illustrates sectional view of flange forming process 900, according to an embodiment. The flange portion 901 of the wheel rim is formed by bending the flange flare 801 to a desired shape.

Figure 10:
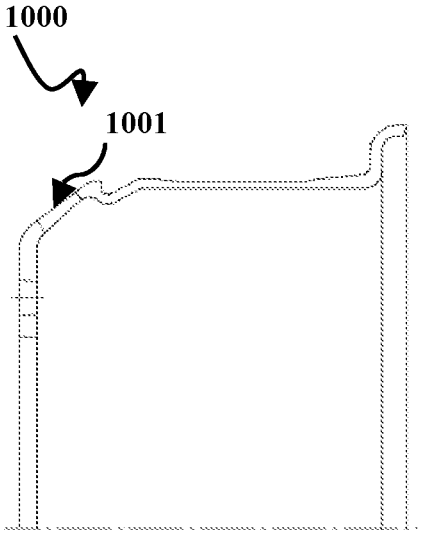
FIG. 10 illustrates sectional view of access hole [A/H] coining and piercing process, according to an embodiment herein.

FIG. 10 illustrates sectional view of A/H coining and piercing process 1000, according to an embodiment. Further, after forming the flange portion at another end of the rim portion, air hole 1001 for the wheel disc is pierced and coining of the air hole is also performed.

Figure 11:
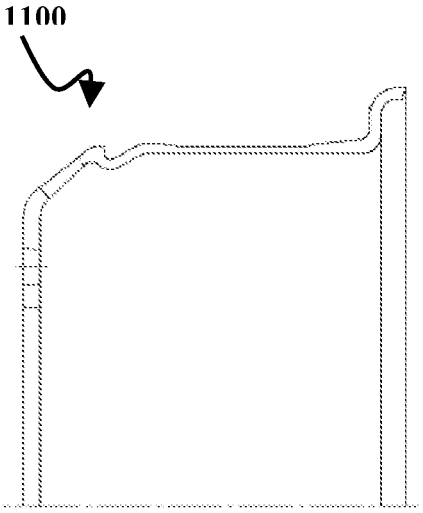
FIG. 11 illustrates sectional view of shrinking process, according to an embodiment herein.

FIG. 11 illustrates sectional view of shrinking process 1100, according to an embodiment. The length of the rim portion is reduced by a shrinking process.

Figure 12:
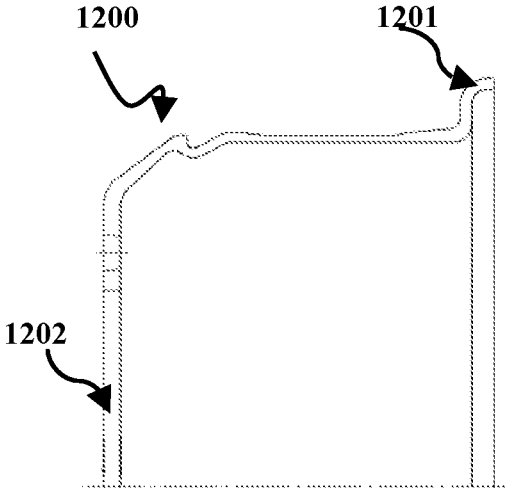
FIG. 12 illustrates sectional view of machining and reaming process, according to an embodiment herein.

FIG. 12 illustrates sectional view of machining and reaming process 1200, according to an embodiment. The flange edge 1201, nave 1202 and bore are undergone for a machining process to avoid sharp edges. The bolt holes are reamed and the bores at the wheel disk portion is chamfered accordingly. The machining process is performed for obtaining final desired shape of the wheel.

According to an embodiment, the novel method for manufacturing a vehicle wheel has simple fabrication techniques. Hence, the method does not utilize any for reverse rolling for obtaining a flange portion and does not require any splitting process for gutter formation. Further, the manufacturing a vehicle wheel can be performed at low cost. Hence the raw material requirement, wastage and labor charges are less compared to all other wheels manufacturing process.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

We claim:

1. A novel method for manufacturing wheels out of single metal band comprising the step of, placing a circular metal band (101) in a mandrel (102) provided at a machining tool for manufacturing the wheel;

forming the metal band/work piece (101) for making a desired length of rim (201) and a wheel disc (202);

spinning a nave portion (401) of the work piece (101) for shaping the wheel disc (202); wherein the nave spinning of the work piece (101) utilized to fix an inner width of the wheel;

spinning the work piece (101) for making a gutter (504) and a disc flange portion (502) of the wheel;

rolling the rim portion of the work piece (101) that is connected to the wheel disc (202) portion, to form the required gutter portion (504) of predetermined shape and thickness;

spinning the rim portion of the work piece (101) further to form a tire seat and a well area (701); wherein the well area (701) has a reduced width compared to the rim portion;

forming a flange flare (801) by bending the rim portion outwardly;

wherein the flange portion of the wheel rim is formed by bending the flange flare (801) to a desired shape; and piercing air hole (1001) for the wheel disc (202), after forming the flange portion (901);

coining the air hole, after piercing air hole (1001) for the wheel disc (202);

reducing the length of the rim portion by a shrinking process, after piercing and coining the air hole (1001); and reaming of bolt holes (503) and chamfering bores at the wheel disk portion of the wheel for attaching the wheel to a wheel axle.

2. The method of claim 1, wherein during forming process for making the rim and a wheel disc (202), the metal band (101) is bent to a predetermined angle (203) to form the desired wheel disc (202) portion (202) with a predetermined thickness.

3. The method of claim 1, wherein the method for manufacturing wheels out of single metal band (101) further comprising the step of, forming bolt holes (503) and a central bore (501), before performing the spinning process for forming the gutter (504) and disc flange portion (502) of the wheel.

4. The method of claim 1, wherein the method for manufacturing wheels out of single metal band (101) further comprising the step of, machining an edge (1201) of the flange to avoid sharp edges; and machining nave (1202) and bore for obtaining final desired shape of the wheel.

* * * * *